United States Patent [19]

Sharp, Jr.

[11] Patent Number: 4,858,804

[45] Date of Patent: Aug. 22, 1989

[54] METHOD AND APPARATUS FOR SEPARATING INTERCONNECTED STACKS

[76] Inventor: Kenneth J. Sharp, Jr., 2725 SW. 216th, Aloha, Oreg. 97006

[21] Appl. No.: 141,295

[22] Filed: Jan. 5, 1988

[51] Int. Cl.[4] ..... B26F 3/02

[52] U.S. Cl. ..... 225/2; 225/5; 225/96.5; 225/97; 225/98; 225/106

[58] Field of Search ..... 225/2, 4, 5, 96, 96.5, 225/97, 98, 103–106

[56] References Cited

U.S. PATENT DOCUMENTS

| | | | |
|---|---|---|---|
| 3,128,929 | 4/1964 | Ruud | 225/103 |
| 4,508,527 | 4/1985 | Uno et al. | 225/103 |
| 4,747,591 | 5/1988 | Beyer | 225/103 |

FOREIGN PATENT DOCUMENTS

| | | | |
|---|---|---|---|
| 3320880 | 12/1984 | Fed. Rep. of Germany | 225/103 |

*Primary Examiner*—Frank T. Yost
*Assistant Examiner*—Hien H. Phan
*Attorney, Agent, or Firm*—Robert L. Harrington

[57] ABSTRACT

A method and apparatus for separating interconnected stacks in a pack of multiple stacks. The pack is confined and an impact wheel is pivoted into the pack at the juncture of the interconnected stacks. The wheel is frusto-conically shaped and the impact of the wheel first breaks the interconnection and then lifts the edge of one of the stacks while a holding shoe on the other stack holds the mated side edge of that juncture. A pivotal spread bar engages individual stacks with the remainder of the pack being confined to complete separation of the interconnection. Conveyor means conveys the stacks towards a packaging machine.

13 Claims, 5 Drawing Sheets

METHOD AND APPARATUS FOR SEPARATING INTERCONNECTED STACKS

FIELD OF INVENTION

A method and apparatus for separating stacks of business forms interconnected in side-to-side relation as generated by the form processing apparatus, separation into individual stacks being desired for packaging.

BACKGROUND OF THE INVENTION

As is typical for many of the paper processing systems, the generation of business forms, such as widely used for business computers, is highly automated. Huge paper rolls, e.g. 4 feet wide and 4 feet in diameter, feed a continuous 4-foot width sheet of paper through a form producing machine. A typical form is 8-½ inches by 12 inches (the 12 inches being oriented across the roll width). The 4-foot wide sheet is thus printed into four side-by-side forms repeated every 8-½ inches. The sheet is perforated by the form producing machine between each form. As the sheet emerges from the machine, the entire width is folded in a serpentine fashion into a stack that is 4 feet wide and 8-½ inches deep. When the desired height representing a desired number of stacked sheets is reached, an operator severs the sheet. He then breaks the single 4-foot wide pack into four 1-foot wide stacks and directs the four individual stacks into a packaging machine which automatically packages the stacks.

The form producing machine is totally automated for not only printing the forms, but also scoring the sheets at the sides and ends for ultimate separation into individual separate sheets. Scoring includes the various processes for establishing a weakened line along which separation will naturally occur when a tearing-type action is applied. Packaging also is automated. However, the individual stacks are separated manually.

Seemingly, this separation process is not a difficult task. The typical procedure of the operator is to repeatedly strike the stack with the heel of his hand along the juncture between the stacks, working his way from the top down. This is repeated for each of the three junctures between the four stacks. If done correctly, the juncture is broken from the front to back a distance of several inches. The stacks are then simply spread apart to complete the separation.

The manual process is generally considered acceptable for production purposes, but it creates disability problems. An operator repeatedly striking these stacks over a period of many hours and many days, incurs arm and hand injuries. It is thus desirable to eliminate the manual operation of separating the stacks.

BRIEF DESCRIPTION OF THE INVENTION

The preferred embodiment of the present invention accomplishes the same two stack separating steps of: (a) striking the interconnected stacks at the juncture (along the scoring) at repeated intervals down the stack height to force a partial split at the juncture front-to-back, and (b) spreading of the stacks to complete the separation.

In brief, the interconnected stacks are shoved into a rack that confines the stack and positions each juncture relative to an impact wheel. Heel bars or shoes press down on each stack at one side of each juncture. The wheels are frusto-conically shaped with the large end in line with the juncture and the small end tapering away from the juncture on the side opposite the shoe. The wheels are pivotally mounted to an axle that is offset from the wheel's center. As the wheel is pivoted, it strikes and lifts the edge of the one stack while the other stack is held down by the shoe. This cooperative action between the striking wheel and holding shoe initiates a tear or break between the stacks at the juncture and then partially continues the tearing action a short distance into the stacks (attributed to the lifting action of the tapered shape of the wheel).

The wheels are moved down the stack height at determined increments, e.g. at 4-inch intervals, and the action is repeated to effect the desired partial split for all of the sheets in the stack. When completed, a plunger moves the now partially joined stacks out of the rack in stages. As each stack is projected out of the rack, the plunger stops and a spread bar pivots the stack away from the rack entrance. This spreading of the stacks completes the separation and furthermore places the now separated stack on a conveyor leading into the automatic packaging machine.

The apparatus and method produces the desired stack separation and eliminates the disabling manual stack separating task previously described. It is at least as efficient as manual separation and performs the task without damaging the fragile forms. A more complete understanding of the invention will be obtained by reference to the detailed description that follows, wherein reference is made to the accompanying drawings.

THE METHOD

Figure 1:
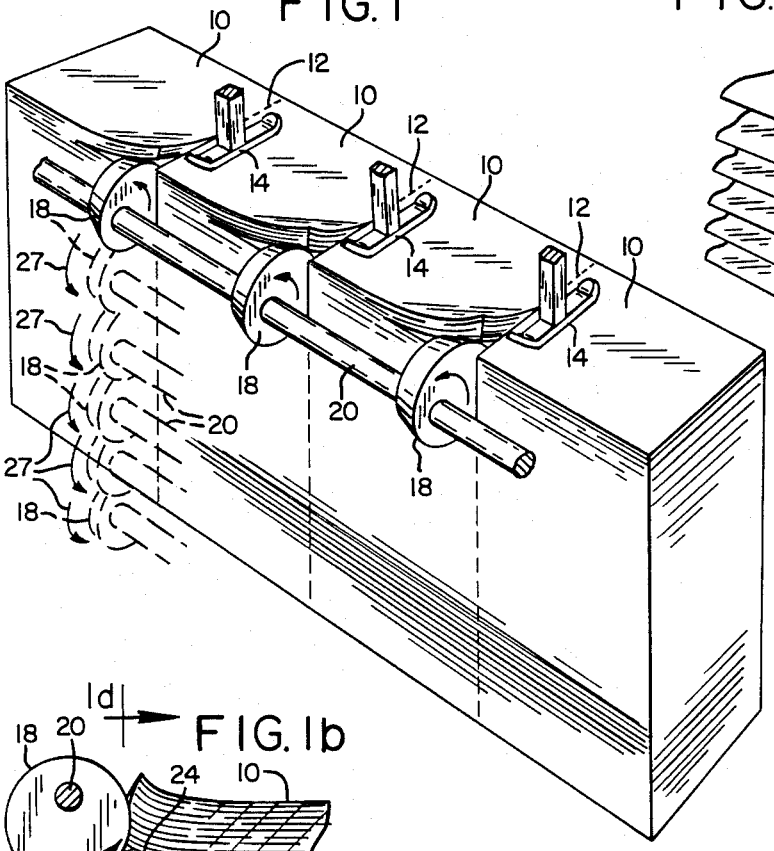
FIG. 1 is perspective view, schematically illustrated, of a pack of forms wherein the initial separating step is being performed in accordance with the invention.
Figure 1A:
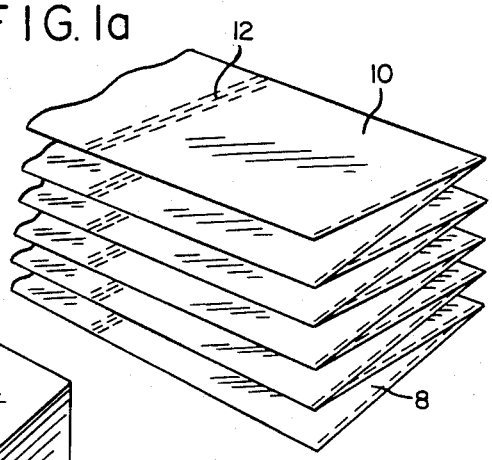
FIGS. 1*a*, 1*b*, 1*c*, 1*d*, 1*e*, 1*f* and 1*g* all schematically illustrate the various stages of the initial separation procedure as generally illustrated in FIG. 1.

Reference is made to FIGS. 1 (including 1*a*–1*g*) and 2 which schematically illustrate the invention. Shown in FIG. 1 is a pack of business forms having been printed from a continuous sheet 8, and folded in a serpentine manner as illustrated in FIG. 1*a*. (As used herein, the term "stack" means layered sheets connected end-to-end with each layer comprising a single business form. A pack is a plurality of interconnected stacks, e.g. as when emerging from the form producing machine.) The pack of forms as shown in FIG. 1 includes four stacks 10 interconnected in side-to-side relation with the juncture 12 scored to facilitate separation. (Perforations on either side of juncture 12 are for use in subsequently feeding the forms through business processing machines and are not a factor in the present invention.)

The apparatus and method of the preferred embodiment is developed to simulate the action of an operator in manually separating the stacks 10. Thus, as illustrated, whereas an operator presses down on the top of the pack just to one side of the juncture 12 with one hand, a shoe 14 of the present invention provides that function by pressing down on the top of the pack.

While so holding the pack, the operator starts near the top and strikes the pack on the other side of the juncture 12 with his other hand, working his way down the stack. The striking action is a lifting/twisting action that first breaks the interconnection at the front edge. The "follow through" then lifts the edges of the stack to tear the scored interconnection a distance into the stacks of several inches.

Figure 1B:
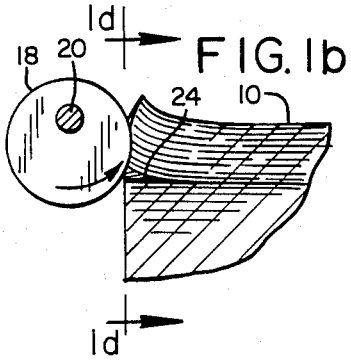
Figure 1C:
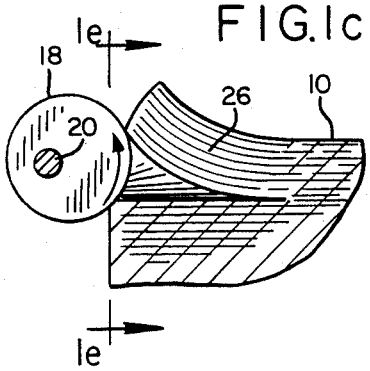
Figure 1D:
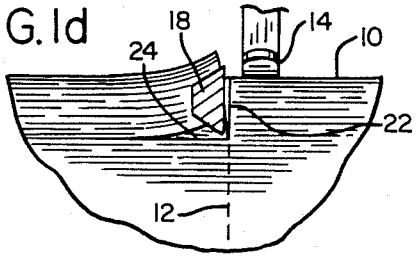
Figure 1E:
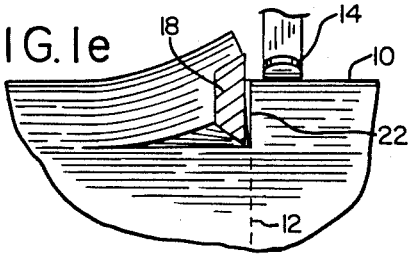
Figure 1F:
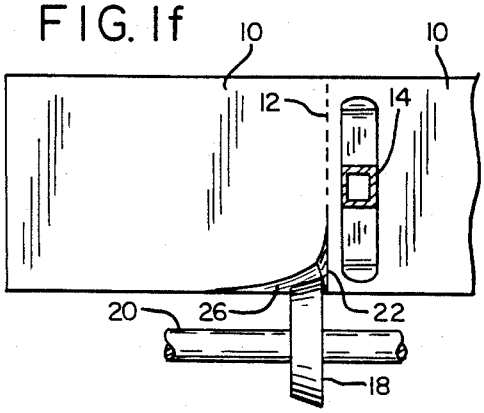
Figure 1G:
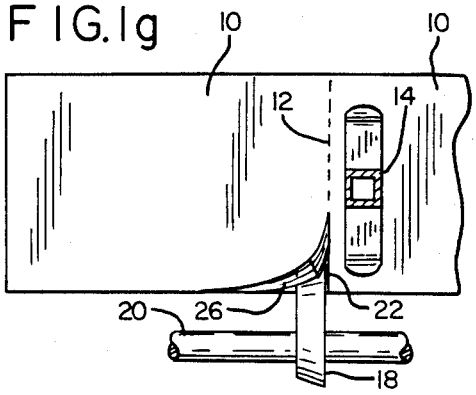

The described manual action is provided in the present invention by a frusto-conical wheel 18 rotated about an offset axis comprised of an axle 20. Reference is first made to FIGS. 1*b* and 1*d*, which illustrate the wheel 18 just as it strikes the pack. As seen in FIG. 1*d*, the wheel is located to the left of juncture 12 with the large end 22 forming a leading edge of the wheel aligned on the juncture 12. The shoe 14 is on the top and just to the right of juncture 12. As the wheel first strikes the pack, the wheel is just starting its upward sweep and the taper of the wheel to the left of the juncture, in combination with the upward movement of the wheel, accomplishes the lifting and twisting action that is desired. The result is illustrated by comparing the drawings 1*c*, 1*e* and 1*g* (side, front and top views respectively) with 1*b*, 1*d* and 1*f* (the same views after pivoting).

A portion 26 of the left stack 10 is lifted away from the remainder of the stack (see split 24 in FIG. 1*b*). The juncture for that section is first broken by edge 22 of the wheel which functions like a dull knife. The taper of the wheel then comes into play to aid in lifting the portion 26 of the stack and in doing so, increases the split 24 a substantial distance along the stack (see FIG. 1*c*). As will be described in a later section, the axle 20 of wheel 18 is carried on a positioner that lowers the shaft 20 following each impacting action. In a spiraling-type movement as indicated by arrows 27 in FIG. 1, this action is repeated in increments, sequentially down the height of the stack.

A multiple of these wheels 18 are carried on the axle 20 that extends the entire length of the pack. Thus, in a single pass down the height of the pack, all the junctures 12 are broken and partially separated.

Figure 2:
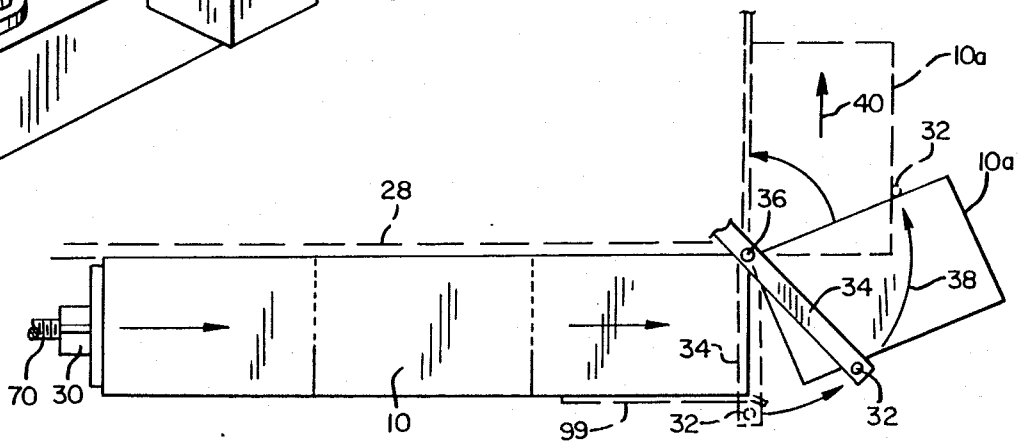
FIG. 2 is a top view, also schematically illustrated, of the second or final separating step in accordance with the invention.

Completion of the separation is illustrated in FIG. 2. Again, the mechanism will be further described in a subsequent section. For purposes of understanding the method, it will suffice to appreciate that the pack is confined in a rack 28 (dash lines) during the initial splitting action of FIG. 1. When that initial action is completed, a plunger 30 pushes the pack out of the rack 28. The plunger 30 is programmed to move the pack in stages. The first stage projects only the first or end stack 10 out of the rack. A spread bar 32 depending from an arm 34 pivoted on post 36, is pivoted so as to engage and pivot the stack as indicated by arrow 38. The following stack is retained in the rack and this pivoting action completes the separation. The stack is swung over to its position 10*a* shown in dash lines and a conveyor engages and carries the stack to the packaging machine as indicated by arrow 40.

The arm 34 returns to its initial position, the plunger 30 pushes the next stack out of the rack and the pivoting operation is repeated. When all four stacks are placed on the conveyor (arrow 40), the plunger 30 is retracted and another pack is pushed into the rack into abutment with plunger 30 and thereby into position for initial separation by the separating wheels 18.

The Apparatus

Figure 3:
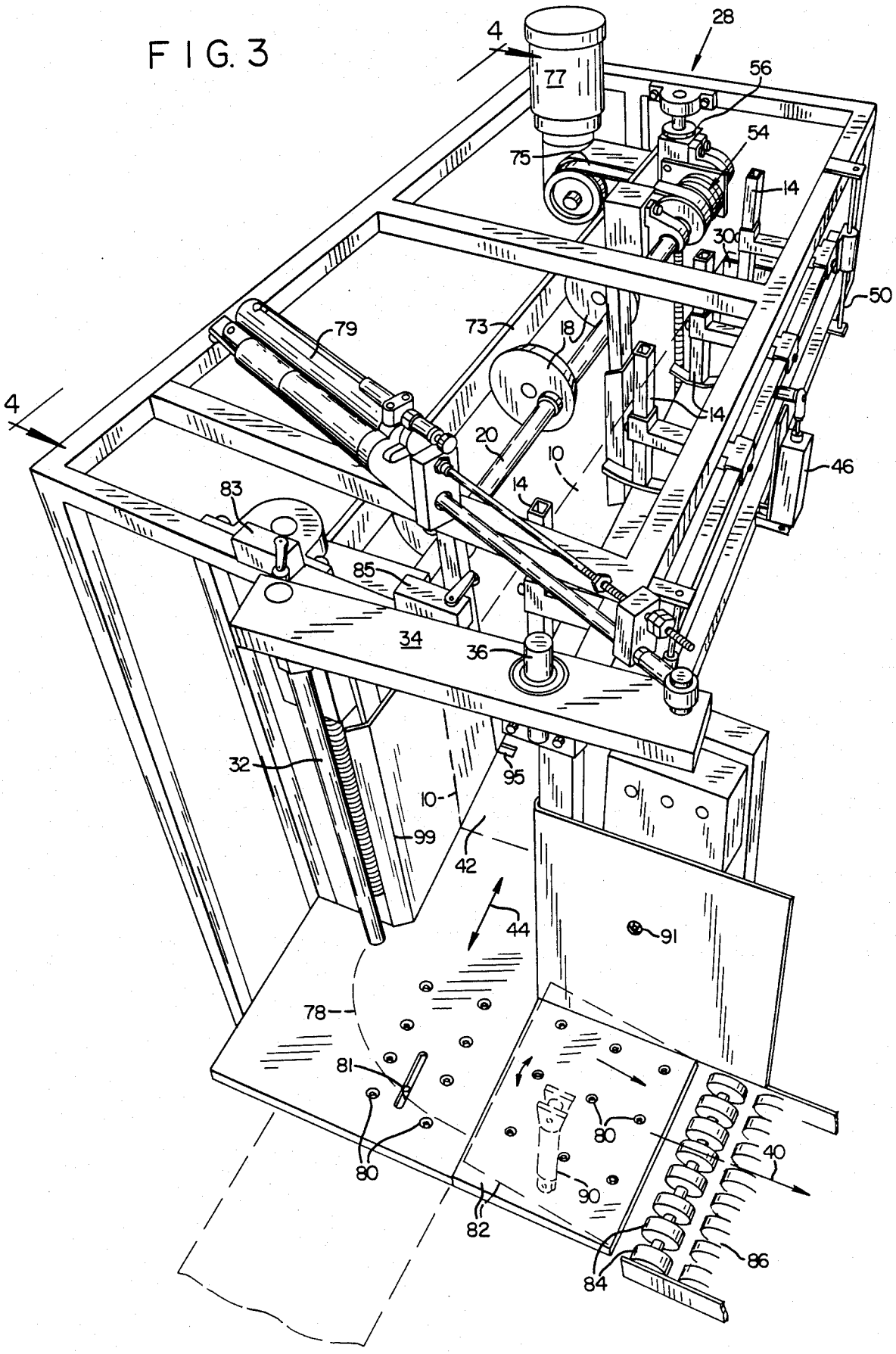
FIG. 3 is a perspective view of a preferred apparatus for carrying out the steps illustrated in FIGS. 1 and 2.
Figure 4:
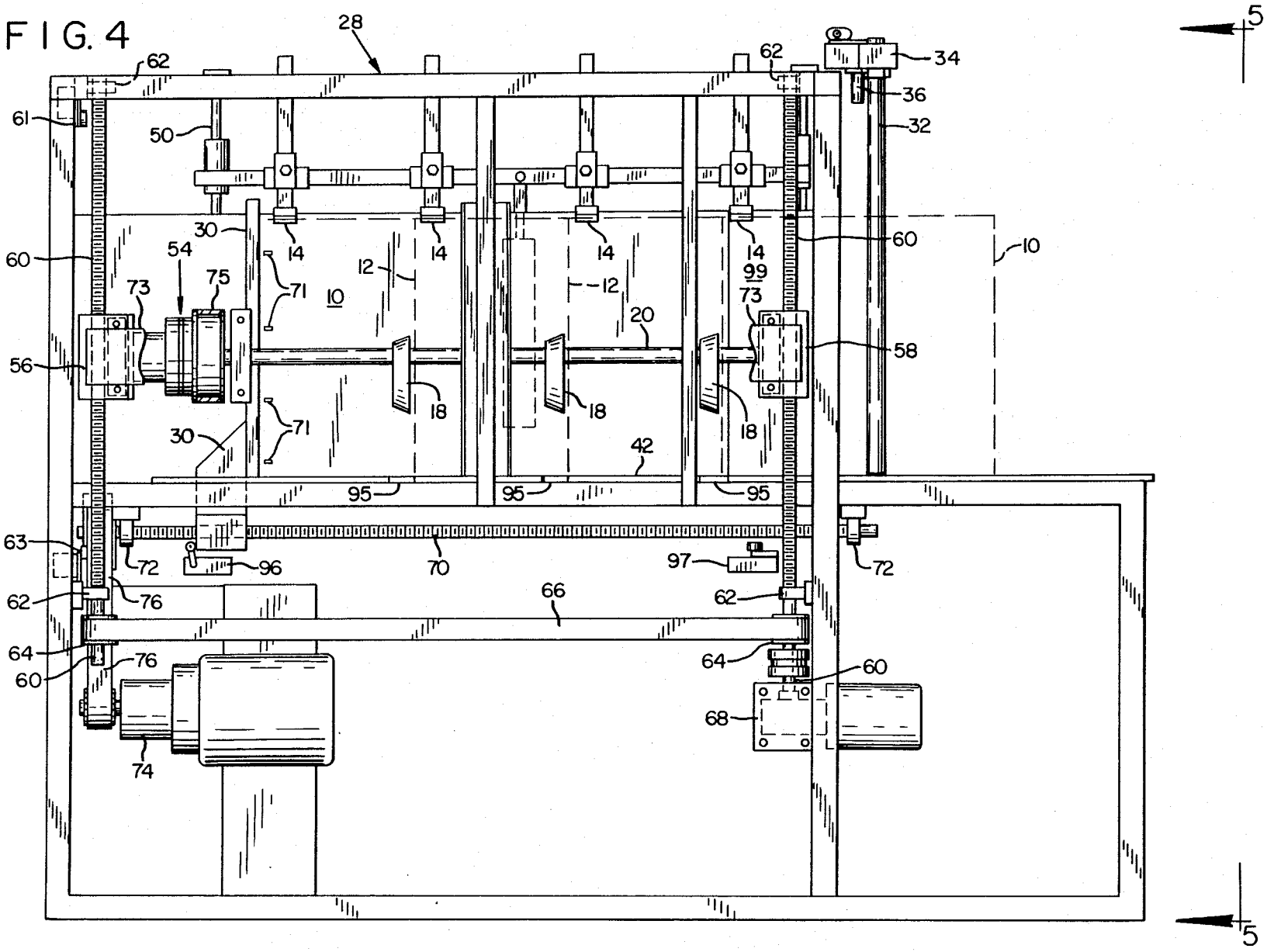
FIG. 4 is a rear view of the apparatus as if taken on view lines 4—4 of FIG. 3.
Figure 5:
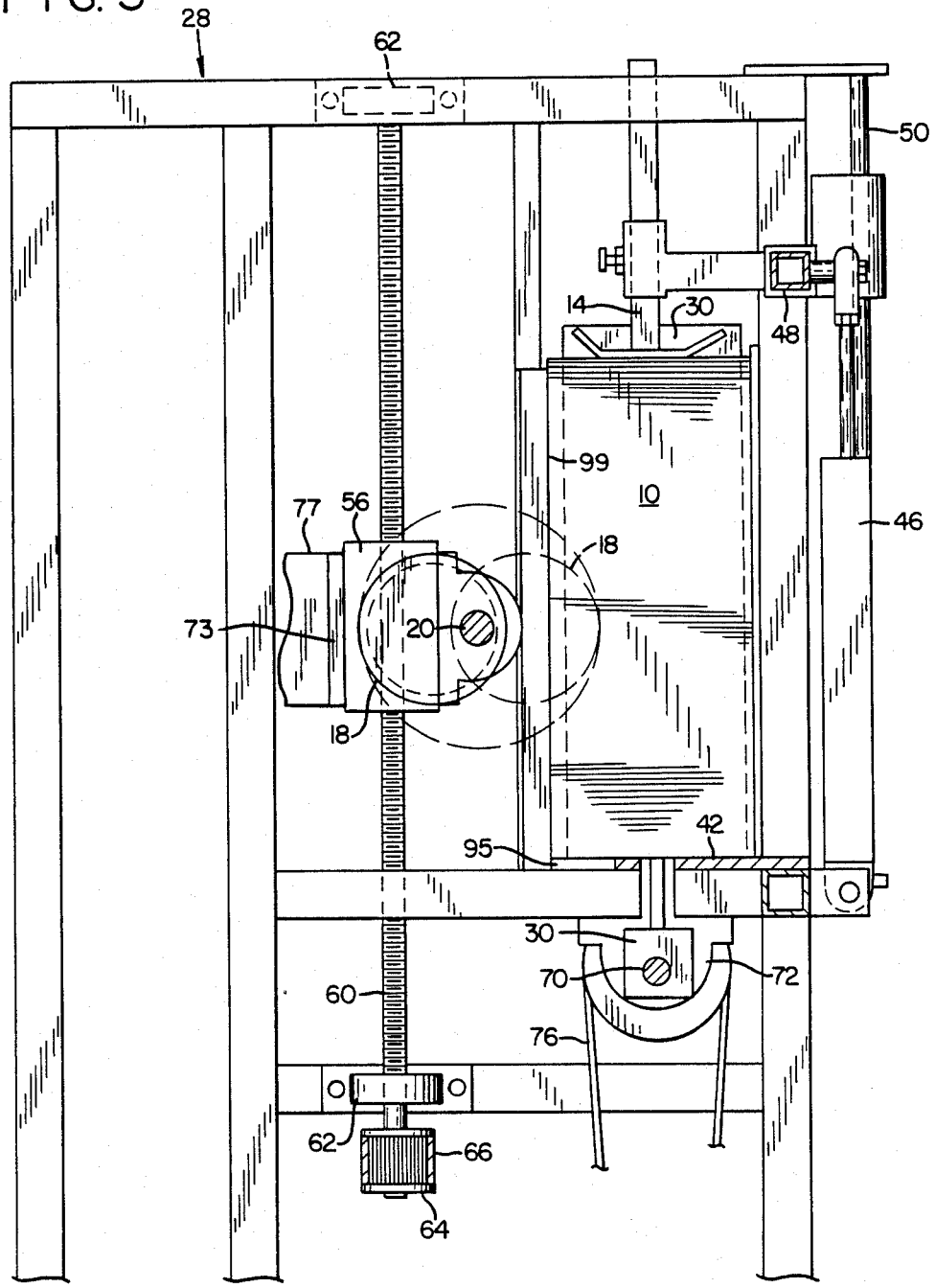
FIG. 5 is a side view of the apparatus as if taken on view lines 5—5 of FIG. 4.

The apparatus for performing the above described two-step separation process is illustrated in FIGS. 3, 4 and 5. The entire supporting structure for the apparatus is referred to as rack 28.

In FIGS. 3–5, the interconnected stacks 10 are illustrated in dash lines. As will be noted, the rack 28 is comprised of various support bars and braces for structural integrity and for mounting the various functioning components as will hereafter be explained. To avoid unnecessary complication in numbering, these support bars and braces will not be separately numbered and in general will be simply referred to as the rack structure 28.

Supported in the rack 28 is a smooth support surface 42 that permits easy sliding of the pack into and out of the rack, the entrance to which is indicated by arrow 44. Surface 42 is an extension of the surface on which the forms are folded and stacked as they emerge from the forms producing machine. Thus the operator simply shoves the forms from the machine and onto the surface 42. The pack is slid along the surface 42 inside the rack structure and under the shoes 14, where it is abutted against the backstop of plunger 30.

As particularly seen in FIG. 4, the shoes 14 are positioned just to the right of the juncture 12. Raising and lowering the shoes is accomplished through a positioner 46 that raises and lowers crossbar 48. Crossbar 48 is guided at its ends on slide rails 50 and thus the shoes 14 are all raised and lowered in unison. They are, of course, raised for initially positioning the pack in the rack.

The separating wheels 18 are spaced just forward of the pack aligned on the junctures 12 as best seen in FIG. 4. The tapered portion of the frusto-conically shaped wheel is extended away from the juncture and away from the shoe 14 located on the opposite side of the juncture. The wheels 18 are mounted on an axle 20 that is offset from the center 52 of the wheel. The affect of the offset arrangement is illustrated in FIGS. 1*c*–1*g*, previously described. All of the wheels 18 are similarly offset. The axle itself is rotatably driven through a clutch mechanism 54, driven by belt 75 from motor 77, mounted on bar 73. Guides 56 and 58 at the opposite ends of axle 20 support this entire structure.

Each of the guides 56,58 are threadedly engaged and supported by vertically oriented threaded screw shafts 60, which in turn are journaled at the top and bottom ends in bearings 62. The shafts 60 project down through the lower bearing 62, where pulleys 64 fixed to each shaft are engaged by a common belt 66. The shaft 60 at one end (the right end in FIG. 4) is driven by motor 68 and through pulleys 64, drive the other shaft 60. Thus guides 56,58 are simultaneously raised and lowered by turning shafts 60 in unison. This accomplishes the incremental movement of the separating wheels represented by arrows 27 in FIG. 1. Limit switches 61 and 63, respectively at the top and bottom of shaft 60, (at the back end of rack 28) limit vertical movement of guides 56,58. Slots 95 in the support surface 42 allow for breaking of the juncture 12 clear through to the bottom sheets of the stacks 10.

The plunger 30 (which includes the wall-like member that pushes the stack) is also actuated by a screw-type positioner. Again, a screw shaft 70 is journaled on end bearings 72 and driven by a motor 74 acting through a belt 76. Turning the screw drives the plunger toward entrance 44 to move the interconnected stacks out of the rack. Thus, on completion of the initial splitting operation, the motor 74 is actuated to turn the shafts 70 and thereby move the plunger 30 and, accordingly, the still partially-joined stacks 10 out of the rack 28. Limit switches 96 and 97 at the front and back of shaft 70 limit movement of the plunger 30.

In sequence, each stack is positioned just outside the entrance 44 and in the pathway of spread bar 32 (the path of spread bar 32 being indicated by dash lines 78). The spread bar 32 is carried by overhead arm 30 that is pivoted on post 36 to the rack structure. Arm 34 is pivoted about post 36 by hydraulic positioner 79 that controllably extends and retracts to pivot the arm between the two positions (see also FIG. 2). The remainder of the pack is secured in the rack and particularly by wall portion 99. An electric eye 81 signals the proper positioning of each stack ready for spreading. Limit switches 83 and 85 indicate the fully retracted and fully extended position of spread bar 32.

When the spread bar returns to its open position of FIG. 3, the stack 10 remains positioned on the platform 82. As shown in FIG. 3, rollers 84 are turning in a direction to induce movement of the stack 10 from platform 82 onto conveyor 86 as indicated by arrow 40. To assist in the sliding movement, first from the rack entrance to platform 82 and then onto conveyor 86, positive air pressure is directed upwardly through air holes 80 in both the support surface 42 and platform 82. Platform 82 is also tiltable by action of piston 90 shown in dash lines in FIG. 3, to tilt platform 82 to the tilted position shown in dash lines. The tilting action and the air pressure, assist rollers 84 in insuring that the separated stack 10 is moved onto the conveyor 86. Presence of the stack on the platform is indicated by a second electric eye 91.

When all of the stacks 10 have been, in turn, moved out of the rack 28 and pivoted by spread bar 32 onto platform 82 and then onto the conveyor as described above, the plunger 30 is then withdrawn to its initial pack-receiving position. Note from FIG. 4, that full withdrawal of the plunger 30 results in engagement of switch 96 which stops the plunger movement to establish the backstop position for the next pack to be separated. Presence of the pack ready for separating is sensed by the electric eyes 71 as seen in FIG. 4. This properly positions the junctures of the stacks 10 of the new pack. The positioner switch 96 can be adjusted as necessary to adjust the location of plunger 30 in this pack receiving position.

Figure 6:
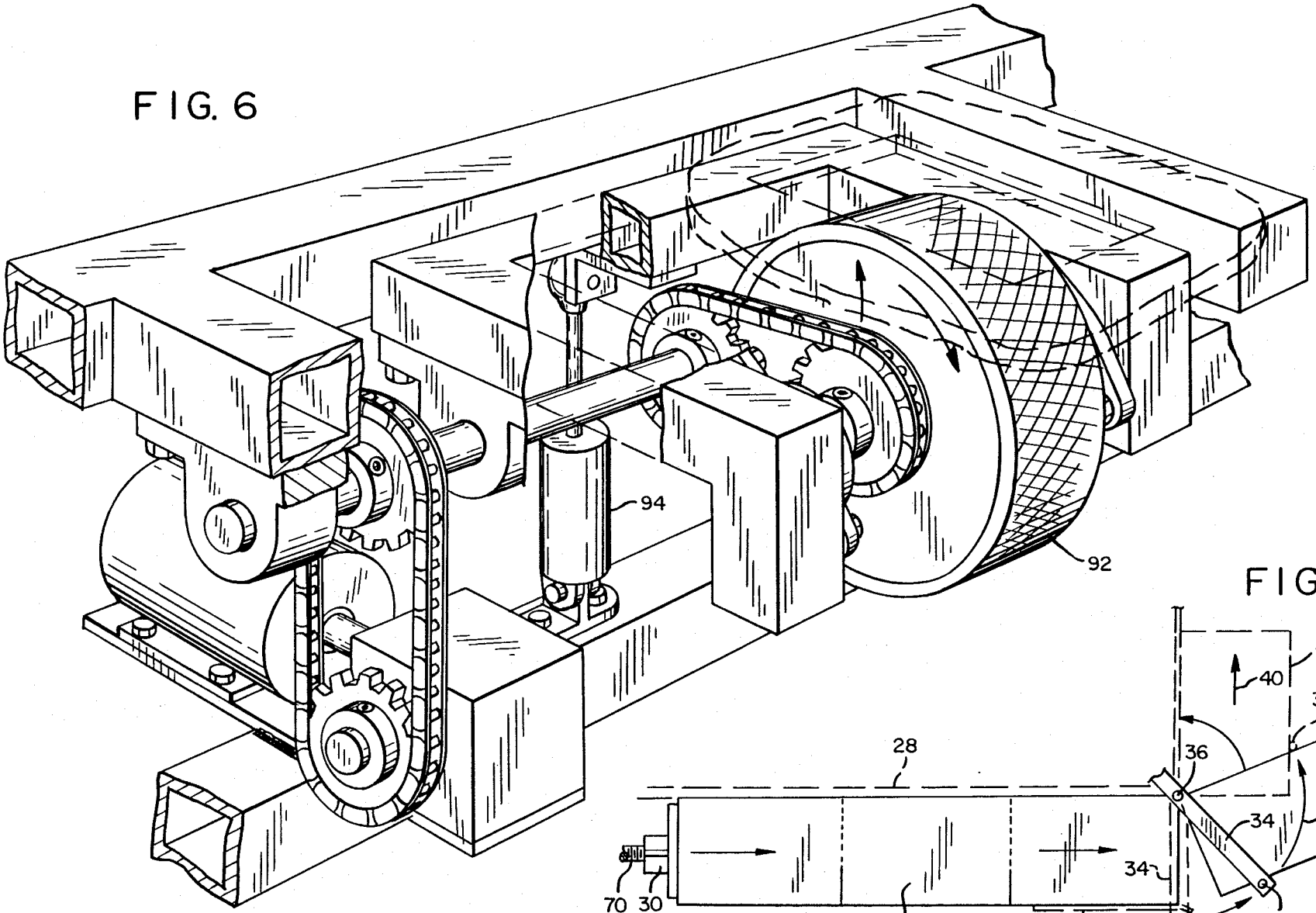
FIG. 6 is a view of an alternate stack moving mechanism as incorporated into the invention.

An alternative to the tilting platform 82, is a conveying wheel 92 illustrated in FIG. 6. The wheel 92 is movable to a position below the platform 82 so as not to interfere with the stack being pivoted onto the platform. The wheel 92 is raised above the platform surface by a piston 94 to engage and move the stack 10 toward the conveyor belt. The wheel is lowered again for the spread arm 32 to deposit the next stack 10 onto platform 82.

These and other advantages will be apparent to those skilled in the art. The invention is, however, not limited to the preferred embodiment described. For example, whereas the frusto-conical shape of the wheels 18 have been found preferable, other shapes of impacting wheels are believed likely to generate a similar splitting, then lifting and twisting action as is desirable for achieving the objective. The claims appended hereto define the invention as broadly encompassed.

I claim:

1. A method for separating a pack of multiple stacks of paper sheets that are interconnecting in side edge-to-side edge relation, the junctures interconnecting the stacks being scored to enhance separation, which comprises;

(a) confining the pack in a rack including impacting means aligned with the junctures, (b) impacting the juncture of the pack by a lifting and twisting action applied to the junctures by the impacting means, said impacting being applied to discrete segments of the pack height and progressively encompassing the entire pack height to establish a partial separation of the stacks of the pack, and (c) forcing a pivotal spreading of the adjacent stacks to complete the separation thereof.

2. A method as defined in claim 1 which includes moving the stacks in sequence out of the rack and wherein the forcing step includes pivotally spreading each stack emerging from the rack while the remainder of the pack is held in the rack.

3. A method as defined in claim 1 which includes applying hold-down shoes at one side edge of each juncture with the lifting and twisting action of the impacting step applied to the adjacent side edge.

4. A method as defined in claim 1 wherein the impacting step is provided by a pivoting frusto-conical wheel with a tapered conical peripheral surface, an offset pivot and a peripheral outer leading edge aligned with each juncture, said wheel engaging the side edge at each juncture as the wheel is pivoted in an upward direction and the tapered conical surface providing the lifting and twisting action thereof.

5. A method as defined in claim 4 wherein the forcing step is provided by pivoting a bar positioned on the rack for engaging and pivoting the stacks as they emerge from the rack to spread the adjacent stacks and complete the separation thereof.

6. An apparatus for separating a pack of interconnected multiple stacks of paper sheets, said stacks being identified in the pack by side edge-to-side edge junctures that have been pre-scored, said apparatus comprising;

(a) a rack including a structure of supports and braces and defining a pack-receiving interior and an entryway thereto, (b) primary separating means including impacting means aligned with the junctures of the multiple stacks of the pack positioned in the interior of the rack, said impacting means mounted to the rack and including actuating means for effecting engagement of the impacting means with the junctures, said impacting means and actuating means cooperatively effecting a lifting action applied to a discrete section at one side edge of each juncture for splitting the discrete section of each juncture, and positioning means for positioning the impacting means sequentially to succeeding discrete sections along the pack height for partial separation of the entire side edge-to-side edge juncture, and (c) secondary separation means for pivotally spreading the adjacent stacks to complete the separation of the stacks from the pack.

7. An apparatus as defined in claim 6 wherein the impacting means comprises a frusto-conically shaped wheel at each juncture pivoted about an axis offset from the wheel center and having an outside edge for impacting and splitting each juncture, and said wheel having a conically-tapered surface extending from said side edge that lifts and twists the side edge of the stack as the wheel is pivoted about said axis and into said pack.

8. An apparatus as defined in claim 7 wherein a holding shoe depends from said rack structure to engage and hold the stack of said pack adjacent the juncture at the side edge mated to the side edge being lifted by the wheel.

9. An apparatus as defined in claim 8 including a plunger mechanism for positioning the pack within the pack receiving interior, and actuating means for said plunger mechanism for forcing sliding movement of the pack out of the pack receiving interior in stages, each of the stages exposing a different one of the partially separated stacks, and said secondary separation means including a spread bar pivotally connected to the rack and engaging and pivoting each of the exposed stacks relative to the remaining stacks in the rack for completing separation of that stack.

10. An apparatus as defined in claim 9 wherein a support surface provides for sliding movement of the pack into and out of the rack interior, and conveyor means for conveying the separated stacks away from the rack.

11. An apparatus as defined in claim 10, wherein the support surface includes a platform portion alongside the entryway, said spread bar pivoting the separated stack onto said platform portion, and stack moving means incorporated into the platform portion to convey the separated stack onto the conveyor means.

12. An apparatus as defined in claim 11, wherein the stack moving means includes air holes in the platform portion, an air source directing positive air pressure from under the platform to produce lifting of the stack, and said platform portion being selectively tiltable for tilting of the platform portion to induce sliding movement of the stack.

13. An apparatus as defined in claim 11, wherein the platform portion has a wheel receiving opening, a stack moving wheel mounted below the platform and aligned with the opening in the platform portion, and means for raising and lowering the stack moving wheel to selectively project the wheel above the surface of the platform portion for engaging and moving a stack supported on the platform portion.

* * * * *